US012636588B1

(12) United States Patent
Gallagher

(10) Patent No.: US 12,636,588 B1
(45) Date of Patent: May 26, 2026

(54) SQUEEZE CONNECTORS FOR FOAM CONSTRUCTION NOODLES

(71) Applicant: ImaginNoodles, LLC, Lancaster, PA (US)

(72) Inventor: Christopher Gerard Gallagher, Lancaster, PA (US)

(73) Assignee: ImaginNoodles, LLC, Lancaster, PA (US)

( * ) Notice: Subject to any disclaimer, the term of this patent is extended or adjusted under 35 U.S.C. 154(b) by 326 days.

(21) Appl. No.: 18/303,107

(22) Filed: Apr. 19, 2023

Related U.S. Application Data

(63) Continuation-in-part of application No. 16/664,891, filed on Oct. 27, 2019, now abandoned.

(60) Provisional application No. 63/381,695, filed on Oct. 31, 2022.

(51) Int. Cl.
*A63H 33/10* (2006.01)

(52) U.S. Cl.
CPC ..... *A63H 33/108* (2013.01); *A63H 33/10* (2013.01)

(58) Field of Classification Search
CPC .. A63H 33/108; A63H 33/101; A63H 33/102; A63H 33/10; A63H 33/12
See application file for complete search history.

(56) References Cited

U.S. PATENT DOCUMENTS

| | | | | |
|---|---|---|---|---|
| 1,203,669 | A | 11/1916 | Whiteside | |
| 1,656,199 | A | 1/1928 | Hodgson | |
| 1,767,745 | A | 6/1930 | Day | |
| 2,171,648 | A | 9/1939 | Ennis et al. | |
| 2,238,039 | A | 4/1941 | De Witt | |
| 2,389,635 | A | 11/1945 | Place | |
| 2,401,976 | A | 6/1946 | Simpson | |
| 2,549,459 | A | 4/1951 | Guest | |
| 2,691,242 | A | 10/1954 | Young | |
| 2,799,118 | A | 7/1957 | Lullo | |
| 3,000,134 | A | 9/1961 | Marini | |
| 3,130,822 | A | 4/1964 | Meyer | |
| 3,205,611 | A | 9/1965 | Onanian | |
| 3,213,745 | A | 10/1965 | Dwyer | |
| 3,431,813 | A | 3/1969 | Johnson | |
| 3,440,784 | A | 4/1969 | Onjukka | |
| 3,456,413 | A | 7/1969 | Fischer | |
| 3,563,582 | A * | 2/1971 | Shroyer | E04B 1/6154 24/581.1 |
| 3,603,026 | A * | 9/1971 | Kishigami | A63H 33/108 446/124 |

(Continued)

FOREIGN PATENT DOCUMENTS

| | | | | |
|---|---|---|---|---|
| CA | 2164240 A1 | | 6/1997 | |
| WO | WO-2017079727 A1 * | | 5/2017 | A63H 33/12 |

*Primary Examiner* — Eugene L Kim
*Assistant Examiner* — Alyssa M Hylinski
(74) *Attorney, Agent, or Firm* — Brian Roffe

(57) ABSTRACT

Squeezable connector for connecting two playset components together includes a body having at least two arrowhead tips. Each arrowhead tip has an expanded form in which it is retainable in connection with a respective playset component and a narrowed form in which it is insertable into and removable from the respective playset components through a portal therein. Each arrowhead tip is squeezable from the expanded form to the narrowed form, and when the manually squeezing or compressive force is released, it returns to its original, uncompressed state.

20 Claims, 18 Drawing Sheets

(56) References Cited

U.S. PATENT DOCUMENTS 3,651,734 A 3/1972 McSherry
3,676,969 A 7/1972 Moore
3,690,031 A 9/1972 Shinoda
3,699,709 A 10/1972 Schmidt
3,716,939 A 2/1973 Pibet
3,769,772 A 11/1973 Oetiker
3,800,494 A 4/1974 Hall et al.
3,960,460 A * 6/1976 Fischer ..... A63H 33/42 411/487
3,987,579 A 10/1976 Palenik, III
4,057,886 A 11/1977 Brass
4,080,752 A 3/1978 Burge
4,086,014 A 4/1978 Jalaguier
4,104,952 A 8/1978 Brass
4,110,932 A 9/1978 Brass
4,159,592 A * 7/1979 Gabriel ..... A63H 33/101 446/124
4,197,781 A 4/1980 Giannuzzi
4,202,132 A 5/1980 Fischer
4,246,718 A 1/1981 Chatani
4,274,324 A 6/1981 Giannuzzi
4,296,524 A * 10/1981 Horholt ..... F16B 5/0607 D8/382
4,300,848 A 11/1981 Waegemann
4,372,076 A 2/1983 Beck
4,391,077 A 7/1983 Gless
4,657,458 A 4/1987 Wollar
4,704,057 A 11/1987 McSherry
4,742,033 A 5/1988 Harris et al.
4,755,141 A 7/1988 Nakai
4,860,410 A 8/1989 Voller
4,878,790 A 11/1989 McSherry et al.
5,028,186 A 7/1991 McSherry
5,199,919 A 4/1993 Glickman
5,253,458 A 10/1993 Christian
5,281,185 A 1/1994 Lee
5,366,332 A 11/1994 Murphy
5,372,450 A 12/1994 Blodgett
5,791,845 A 8/1998 Fulop
5,857,819 A 1/1999 Lary et al.
5,881,515 A * 3/1999 George ..... E04B 2/702 52/169.4
5,929,906 A 7/1999 Arai et al.
6,074,144 A 6/2000 Meyer
6,135,425 A * 10/2000 Platt ..... E04H 17/143 256/65.09
6,478,649 B1 * 11/2002 Hoback ..... A63H 33/06 446/85
6,595,825 B1 7/2003 De Wilde
6,652,206 B2 11/2003 Heflin et al.
6,931,803 B1 8/2005 Davis et al.
6,938,966 B1 9/2005 Rouwhorst
6,964,593 B1 11/2005 Stevens
7,364,440 B2 4/2008 Gobron et al.
7,517,270 B2 * 4/2009 Marzetta ..... A63H 33/101 446/85
7,669,324 B2 3/2010 Daito
7,681,843 B2 * 3/2010 McQueeny ..... A47F 5/0884 248/222.12
8,074,418 B2 12/2011 Thiagarajan
8,475,226 B2 7/2013 Comfort
8,567,149 B2 10/2013 Kuzmin
8,662,328 B2 3/2014 Boisvert
8,671,640 B1 3/2014 Thomas
8,850,683 B2 10/2014 Haughey et al.
8,864,546 B1 10/2014 Capriola
8,961,259 B2 2/2015 Maggiore et al.
9,033,761 B2 5/2015 Azmani
9,238,179 B2 1/2016 Carpenter
9,303,400 B2 * 4/2016 Maeers ..... E04B 2/18
9,377,042 B2 6/2016 De Wilde
9,399,177 B2 7/2016 Cohcella
9,458,872 B2 10/2016 Nelson
9,714,673 B2 * 7/2017 Phillips ..... F16B 12/26
9,737,825 B2 8/2017 Donohoe
9,789,417 B2 10/2017 Vandoren
9,814,998 B2 11/2017 Nei
10,130,894 B2 11/2018 Peller
10,183,229 B2 1/2019 Donohoe
10,272,353 B2 4/2019 Oh
10,398,999 B2 9/2019 Cochella
10,493,371 B2 12/2019 Cochella et al.
10,518,193 B2 12/2019 You
10,526,783 B2 1/2020 Hon
10,597,093 B2 * 3/2020 Lee ..... B62D 27/06
11,293,471 B2 * 4/2022 Porter ..... F16B 5/04
2003/0024187 A1 2/2003 Wilt
2003/0036333 A1 2/2003 Oakley
2003/0049992 A1 3/2003 Leemon
2004/0244158 A1 12/2004 Awakura et al.
2007/0218801 A1 9/2007 Weinshanker
2008/0142670 A1 6/2008 Cvelbar et al.
2008/0196222 A1 8/2008 Park
2009/0301012 A1 12/2009 Stein
2010/0009593 A1 1/2010 Hottl
2010/0011686 A1 1/2010 Stein
2010/0151765 A1 6/2010 Kwak et al.
2010/0210172 A1 8/2010 Worthington et al.
2010/0273388 A1 10/2010 Carlson et al.
2012/0020726 A1 1/2012 Jan
2012/0184174 A1 7/2012 Kwak et al.
2012/0269570 A1 * 10/2012 Felber ..... A63B 31/00 403/345
2013/0095722 A1 4/2013 Cochella
2013/0330998 A1 12/2013 Fox et al.
2014/0273712 A1 9/2014 Uttley et al.
2015/0247328 A1 9/2015 Correia et al.
2015/0375132 A1 12/2015 Cheung
2016/0136536 A1 5/2016 Ben Shalom
2016/0160515 A1 6/2016 Wallance
2016/0310864 A1 10/2016 Cheung
2017/0298976 A1 * 10/2017 Porter ..... F16B 19/08
2018/0118488 A1 5/2018 Suzuki et al.
2018/0177488 A1 6/2018 Pathania et al.
2018/0296938 A1 10/2018 Gallagher
2018/0296983 A1 10/2018 Dacey, Jr. et al.
2020/0038772 A1 2/2020 Wong et al.
2020/0054957 A1 2/2020 Chan et al.
2020/0054958 A1 2/2020 Gallagher
2020/0282322 A1 9/2020 Gallagher
2021/0131096 A1 5/2021 Mordechai

* cited by examiner

SQUEEZE CONNECTORS FOR FOAM CONSTRUCTION NOODLES

CROSS-REFERENCE TO RELATED APPLICATIONS

The present application is a continuation-in-part of U.S. patent application Ser. No. 16/664,891 filed Oct. 27, 2019, and claims priority of U.S. provisional patent application Ser. No. 63/381,695 filed Oct. 31, 2022, the disclosures of which are incorporated by reference herein.

FIELD OF THE INVENTION

The present invention relates generally to connectors or fasteners for toy construction playsets and more particularly to connectors for toy construction playsets that are easy to use and provide a secure attachment of adjacent components of the playset to one another, or possibly two parts of the same component.

The present invention also relates to toy construction playsets including lightweight logs and other building components made of expanded plastic foam, such as polyethylene or polyurethane, and connectors to enable attachment of the logs and other building components to one another in numerous and varied forms. Even more particularly, the present invention relates to toy construction playsets and soft, creative environments that can be built to tower above a child's head without concern of injury due to collapse.

The present invention also relates generally to toy construction playsets with one-piece molded connectors to hold toy construction flexible substrates together that are large enough to pass the toy industry's Small Part Gauge.

BACKGROUND OF THE INVENTION

Children's blocks have forever been a source of creative play. Frank Lloyd Wright, and other thought leaders famously credit their childhood blocks as a valuable educational resource from their early youth and/or a significant outlet for their creative minds from a very early age. While playing with blocks is often an immersive experience, few sets of blocks allow for the construction of structures that are full size play sets. The risk of such a structure falling on a child has typically prevented this scale of immersive play set.

The blocks are great for inside or outside play. While the playset of blocks is designed for the real world, a computer-based playset for the computer world is one option. In this way, children can plan their designs on the computer, make them in the real world and play with them in either environment.

Children also have access to toy construction playsets including expanded plastic foam noodles that are hollow custom extrusion profiles resembling logs, and hereinafter referred to as "foam logs" or "logs". These logs are often connectable to each other with the use of fasteners designed to engage adjacent logs in a secure manner.

The inventor has several prior applications directed to logs and related products, including, U.S. patent application Ser. No. 15/344,333 filed Nov. 4, 2016, Ser. No. 15/951,199 filed Apr. 12, 2018, Ser. No. 16/664,891 filed Oct. 27, 2019 and Ser. No. 16/884,258 filed May 27, 2020, all of which are incorporated by reference herein.

OBJECTS AND SUMMARY OF THE INVENTION

It is an object of at least one embodiment of the present invention to provide new and improved connectors for toy construction playsets, toy construction playsets including such connectors, and methods for using such toy construction playsets.

It is another object of at least one embodiment of the present invention to provide new and improved one-piece molded connectors to hold foam toy construction flexible substrates together, toy construction playsets including such connectors, and methods for using such toy construction playsets.

It is another object of at least one embodiment of the present invention to provide molded connectors for toy construction logs that are connectable to each other and which squeeze or compress to pass easily through holes or portals in walls of each of a pair of adjacent logs or other toy construction playset components.

It is another object of at least one embodiment of the present invention to provide a toy construction playset that is full size.

It is another object of at least one embodiment of the present invention to provide a full size toy construction playset that eliminates the risk of injury from falling pieces or injuries to children jumping off structures formed by the playset.

It is another object of at least one embodiment of the present invention to provide a building system for children that allows them to construct structures from hollow foam extrusions or foam logs that are stackable so they can make playsets of their own design or existing designs in which they can hide, play, and let their imaginations soar.

The importance of a one-piece connectors construction cannot be underestimated in that it allows everyone and in particular small children to use the connectors while not requiring the dexterity needed to align and manipulate small parts such as nuts and bolts and other two piece fastening systems. One-piece plastic connectors also allow for low-cost fabrication so the toys are affordable. All described connectors are of the size that pass the Children's Choke Gauge safety standard.

In order to achieve one or more of the above objects, or possibly others, a connector that enables two playset components to be connected together in accordance with the invention includes a body having at least two arrowhead tips. Each arrowhead tip has an expanded form in which it is retainable in connection with a respective playset component and a narrowed form in which it is insertable into and removable from the respective playset components through a portal therein. Each arrowhead tip is squeezable from the expanded form to the narrowed form, and when the manually squeezing or compressive force is released, it returns to its original, uncompressed state.

In one embodiment, the body has a unitary construction in that it is made of one piece of material. Each arrowhead tip includes a tip edge and a pair of angled parts separated from one another to define a void therebetween. The angled parts extends in opposite directions from the tip edge. Each arrowhead tip has undercut surfaces on an opposite side from the tip edge. The body includes a portion with a reduced dimension or neck relative to a side of a respective arrowhead tip opposite the tip edge to thereby define the undercut surfaces, and which portion is compressible to thereby cause movement of the arrowhead tip into its narrowed form.

The body can have only two arrowhead tips, one at each of two opposite ends of the body and which are oriented in opposite directions. In this embodiment, the body has side walls extending between the two arrowhead tips, a center rib extending outward from each side wall, and a pad at an outward end of each center rib. Pressing the pads inward causes the side walls to be moved toward one another and narrowing of the arrowhead tips.

In another embodiment, the arrowhead tips are laterally spaced apart from one another and oriented in a common direction. This spacing may be obtained by a flat intermediate portion, with the arrowhead tips being arranged on opposite edges of the intermediate portion and oriented in the same direction. Each arrowhead tip can include a tip portion including a tip edge and a pair of angled parts separated from one another to define a void therebetween, with the angled parts extending in opposite directions from the tip edge. Each arrowhead tips can also include opposed side walls connected to the tip portion and defining a space continuous with the void of the tip portion of a respective arrowhead tip. The side walls extend from the undercut surfaces defined between the tip portion and the side walls. Notches may be provided in the tip portion to form living hinges between the angled parts and the undercut surfaces, which aid in compression.

In one embodiment, the flat intermediate portion includes an elongate living hinge extending in a direction transverse to a line between the arrowhead tips to enable the arrowhead tips to pivot relative to one another.

Another embodiment of a connector that enables two playset components to be connected together in accordance with the invention includes a body having at least two arrowhead tips, and wherein each arrowhead tip includes a compressible triangular region and a rectangular region behind the triangular region and defining undercut surfaces between the triangular region and the rectangular region. The triangular region is compressed or squeezed to reduce its size and enable its insertion into or removal from a portal in the playset component. The features described above may be incorporated into this embodiment.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

A better understanding of the disclosed technology will be obtained from the following detailed description of the preferred embodiments, taken in conjunction with the drawings and the attached claims.

BRIEF DESCRIPTION OF THE DRAWINGS

Some embodiments of the invention are described herein with reference to the accompanying figures. The description, together with the figures, make apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

DETAILED DESCRIPTION OF THE INVENTION

Figure 1:
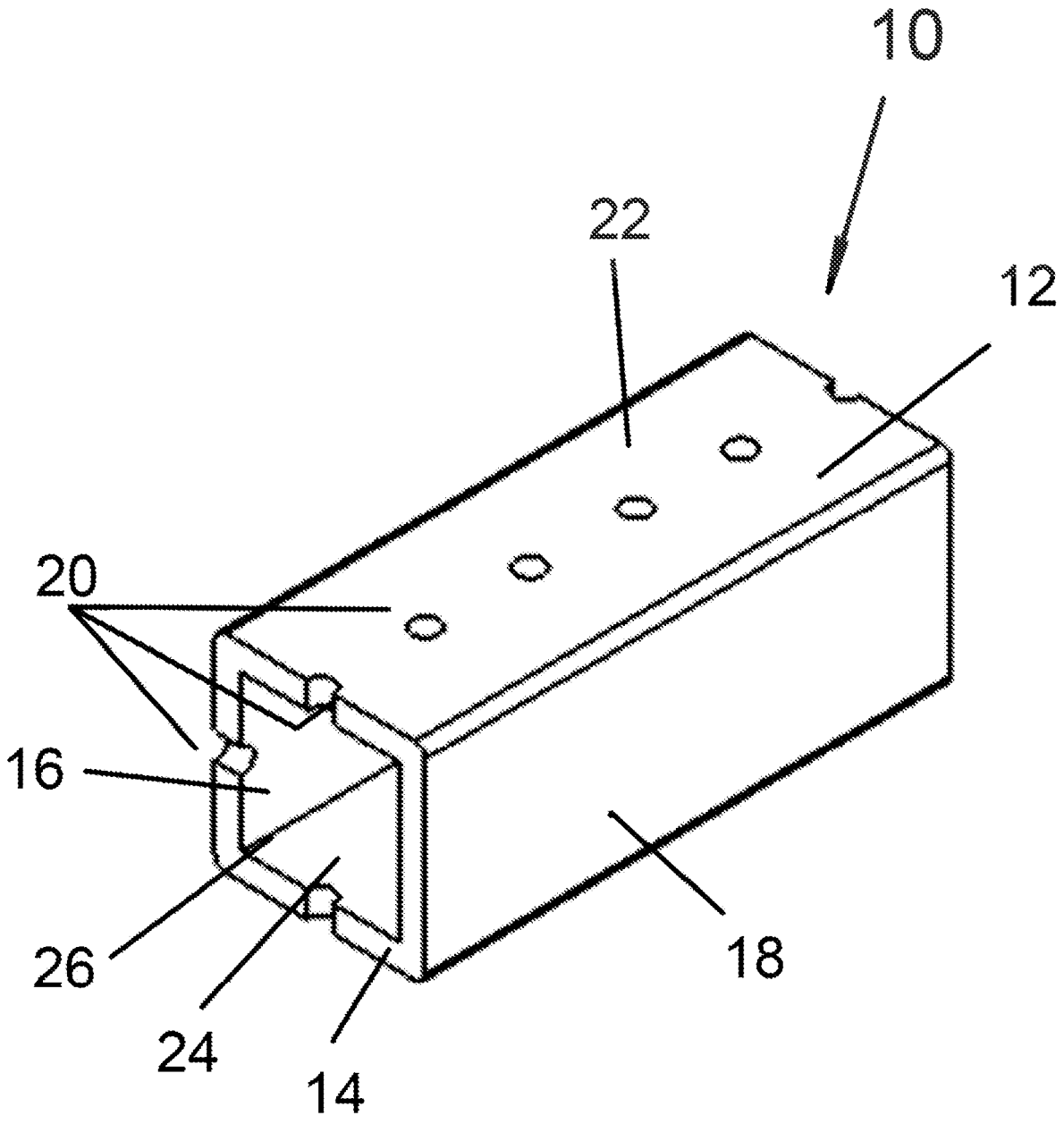
FIG. 1 is a perspective view of a log used in a playset in accordance with the invention and with a connectors in accordance with the invention.

The ensuing detailed description provides an explanation of various aspects of the disclosed technology. The purpose of this explanation is to provide a thorough understanding of the different aspects of the disclosed technology. This description is not intended to limit the scope, applicability, or configuration of the disclosed technology. It will also be apparent to one skilled in the art that the disclosure may be practiced without specific details being presented herein. Various changes may be made in the function and arrangement of elements without departing from the spirit and scope of the disclosed technology as set forth in the appended claims. Furthermore, well-known features may be omitted or simplified for clarity.

To aid in describing the describing the disclosed technology, directional terms may be used in the specification and claims to describe portion of the present technology (e.g., upper, lower, left, right, etc.) These directional definitions are merely intended to assist in describing and claiming the disclosed technology and are not intended to limit the disclosed technology in any way. In addition, reference numerals that are introduced in the specification in association with a drawing figure may be repeated in one or more subsequent figure without additional description in the specification, in order to provide context for the other features.

The terms “noodle”, “log” and “block” as used herein are interchangeable. A log for purposes of this disclosure is defined as an elongated, hollow tube or cylinder optionally with two or more flattened exterior sides. The flattened sides allow the logs to be easily stacked like logs in a log cabin. The logs are made of the same material as foam “pool noodles”. The logs can have a larger diameter than most pool noodles with three relatively flat sides each with holes or portals and a fourth side that is flat or optionally curved with no holes so playsets appear to be made from large foam logs.

The term "substantially flat planar surface" as used herein is defined as a flat section along the length of the side of a log and from 25 percent to 100 percent of the width of a side of the log.

Expanded polyethylene extrusions provide a lightweight, soft, structural material that can allow children to safely build play structures of their own imaginations that reach over their heads without concern of injury. The blown polyethylene hollow extrusions interlock with simple connector designs that allow a child to assemble log cabins, forts, castles, boats, and other imaginative structures quickly and easily with no tools other than a toy saw, if desired.

Referring to FIG. 1, a log 10 of blown or extruded plastic is included in a construction playset according to the invention and has top wall 12, a bottom wall 14, a left side wall 16 and a right side wall 18. Three of the walls, e.g., the top, bottom, and left side walls 12, 14, 16, include holes or portals 20. There may be a row of such portals 20 along only part of or along the entire longitudinal extent or length of the log 10. The portals 20 extend entirely through the respective wall 12, 14, 16 from the outer surface 22 of the log 10 to the inner surface 24 of the log 10. The inner surface 24 defines a hollow interior 26 of the log 10. The top, bottom, left and right walls 12, 14, 16, 18 may have a substantially flat planar outer surface or be curved. Also, it is not required that three of the walls include portals 20, and any number of the walls 12, 14, 16, 18 may include portals 20, whether one, three or all four. The dimensions of the log 10 may be varied as desired, e.g., its length and the width and thickness of the walls 12, 14, 16, 18. It is also possible to form the logs 10 with any number of walls and not necessarily four discrete walls. The disclosed logs 10 do not in any limit the use of the connectors disclosed herein.

The logs 10 may define a hollow circular, square, rectangular, triangular, or other shaped extruded foam profiles.

A variation of the log 10 has a custom extrusion profile with a thinned section, or channel 28 in two opposing elongate walls (see FIG. 6), which cooperate since they are ideally directly opposite one another, to enable the log 10 to be flattened to reduce shipping box size and costs. The channels may function as opposing hinges so the log 10 can be flattened with less force. The channels may extend the full length of the log 10 reducing the required compression force and making the log fold predictably. The channels aid flattening of the log when its profile geometry is symmetrical, asymmetrical, curved, or flat. This channel detail in the log 10 profile enables the product line to be made affordable by reducing shipping costs dramatically. Compressed logs illustrate the ease of compression before shipping. When the compressed logs are unpacked, they return to their original extrusion non-compressed, full width.

Figure 2:
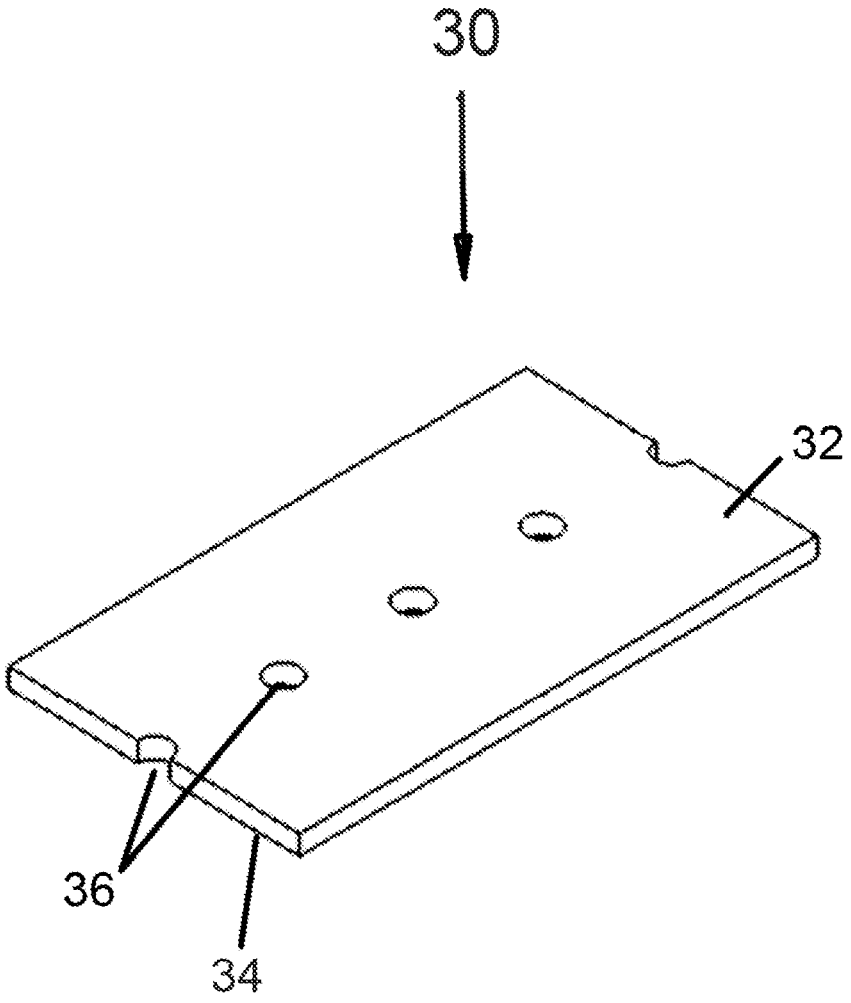
FIG. 2 is a perspective view of a panel used in a playset in accordance with the invention and with a connectors in accordance with the invention.

Instead of or in addition to one or more logs 10, a construction playset in accordance with the invention may include a panel 30 as shown in FIG. 2. Panel 30 includes upper and lower substantially flat planar surfaces 32, 34 and portals 36. There may be a row of such portals 36 along only part of or along the entire longitudinal extent or length of the panel 30. The portals 36 extend entirely through the panel 30 from the outer surface upper surface 32 to the lower surface 34. The dimensions of the panel 30 may be varied as desired, e.g., its width, length, and thickness. Panel 30 may also be curved.

The logs 10, panels 30 and possibly other substrates may be assembled and will stay together until a child or parent deliberately disassembles them. Connectors and locking elements are used in portals formed in, or subtracted from, the foam extrusion.

Logs 10 and panels 30 made of plastic foam extrusions provide a lightweight, soft, structural material that allows children to safely build and play in structures of their own imaginations, even if those structures reach well over their heads. The foam extrusions provide both structure and strength without causing concern for injuries should the structure fall on a child. The foam logs are held together with a series of connectors that are removable, discussed below. These connectors allow a child to assemble foam logs into cabins, forts, castles, boats, and other imaginative structures quickly and easily with no tools other than possibly a toy miter and toy saw. The locking connectors provide a greater interference fit with the logs than other removable connectors so the structures will stay together better where the standard connectors might pop out.

In some situation such as a swimming pool, using a locking connector in accordance with the invention, children can construct playsets that do not come apart accidentally. The locking connectors are inserted in a similar way as prior art connectors but the connector opens to create a greater interference fit with the foam substrates.

Figure 3:
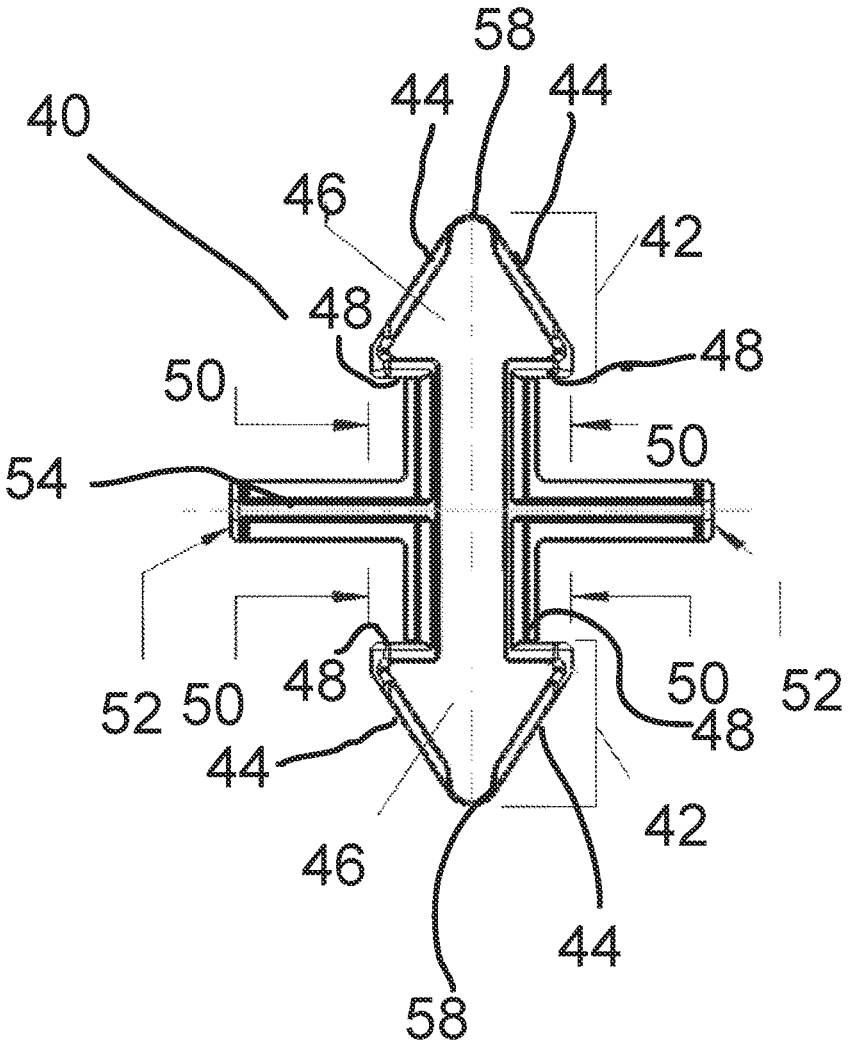
FIG. 3 is a front view of a squeeze connector in accordance with the invention.
Figure 4:
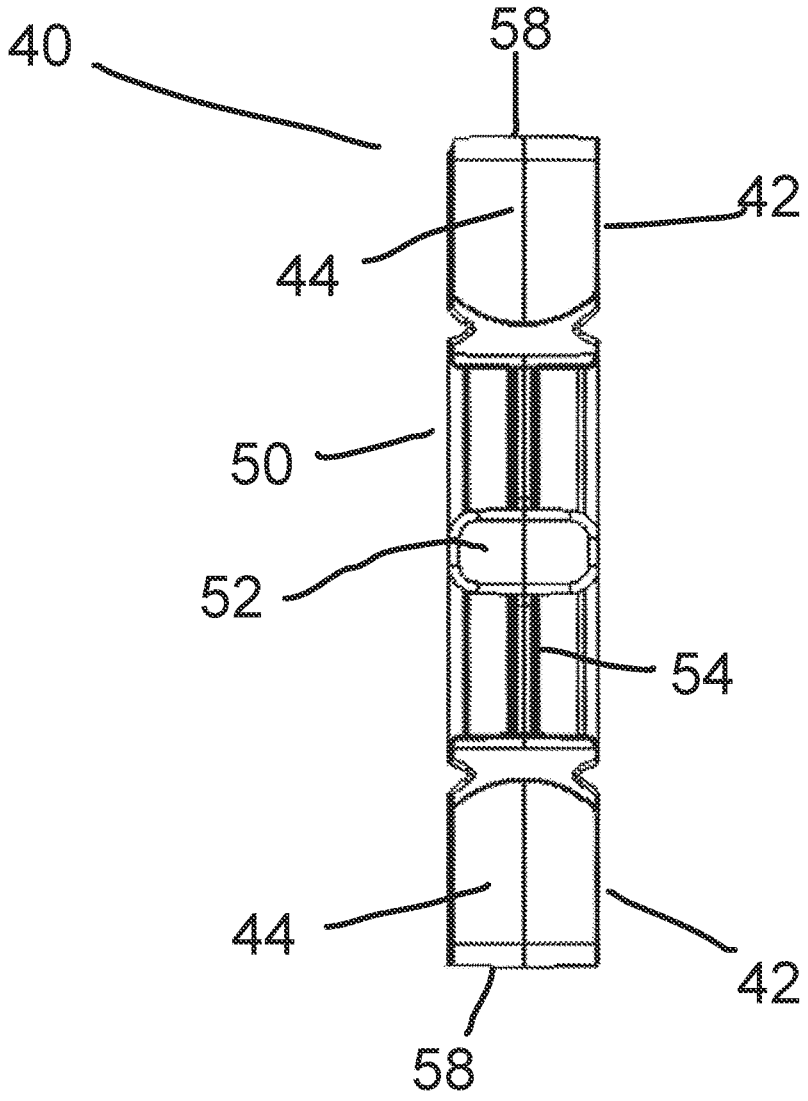
FIG. 4 is a top view of the squeeze connector shown in FIG. 3, the bottom view being identical.
Figure 5:
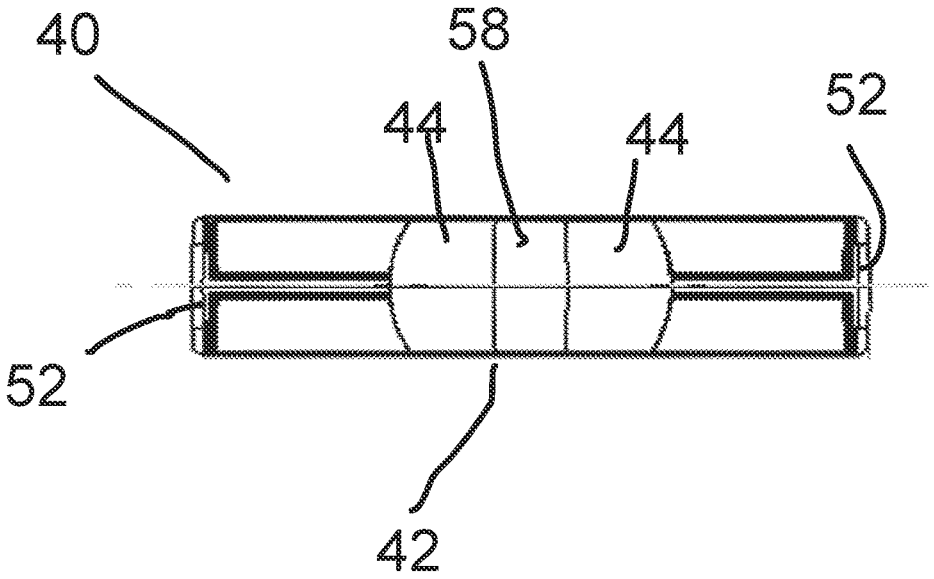
FIG. 5 is a side view of the squeeze connector shown in FIG. 3, both side views being the same.

Referring now to FIGS. 3-5, a squeeze connector 40 in accordance with the invention has a unitary construction, i.e., is made of a single piece of plastic. Connector 40 is used to lock two pieces of extruded foam together, e.g., two logs 10, by exerting a force pressing the logs against one another. As seen in FIGS. 4 and 5, the connector 40 has a uniform thickness, which is preferred but not required.

Connector 40 includes opposed arrowhead tips 42 each defined by a pair of angled parts 44 and having a void 46 between the angled parts 44 (FIG. 3). The angled parts 44 extend in opposite directions from the tip edge 58, and toward the other end of the connector 40. An angle of about 30 degrees to about 60 degrees to the horizontal axis passing through the tip edges 58 is suitable but can vary as desired. The tip edge 58 is preferably configured to act like a living hinge and enable the angled parts 44 to be brought closer together during compression and bias the angled parts 44 away from one another when compressive force is not present.

Figure 7:
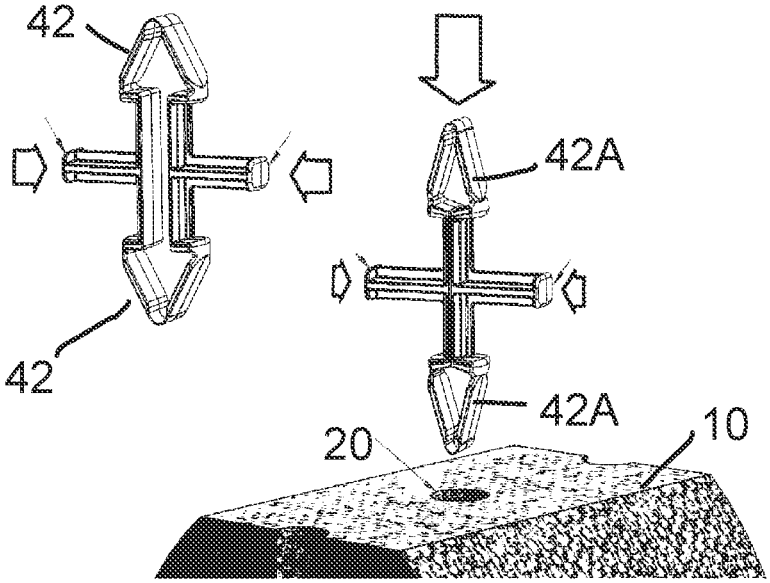
FIG. 7 shows a perspective view of a log and two squeeze connectors in accordance with the invention.

Voids 46 enable the angled parts 44 to be brought closer to one another to compress or squeeze the tips 42, narrowing their cross-sectional area, and enable their insertion in the narrowed form into two aligning portals in the logs, or two aligning portals in the same log that may be bent, folded or curved over itself. Hence, the connector 40 is provided with its squeezable nature. In FIG. 7, the left side shows the connector 40 without compressive force along with arrows indicating where compressive force is to be applied. The right side shows the connector 40 during compression wherein it can be seen that the tips 42 are narrower, now designated 42A, and the side walls are closer together.

The logs 10 and connectors 40 are designed relative to one another such that the tips 42 are larger than the portals in the logs. Once the compressive force on the tips 42 is removed, i.e., after the tips 42 have been inserted into and are present in spaces in the logs, the tips 42 expand to their original width, geometry and shape. This expansion is a property of the material from which the connectors 40 are formed, e.g., memory plastic. Since the undercut surfaces 48 of the tips 42 press against the inner surface of the logs when an attempt is made to remove the tips 42 without squeezing the connectors 40, the logs are held together. Connectors 40 cannot be easily removed from the logs until the connectors 40 are again squeezed, and purposely removed.

Connector 40 has a reduced neck 50 adjacent to the arrow-shaped tips 42 so when they are compressed and passed through, for example, the portal 20 in the log 10 and released, the tips 42 seat themselves inside the portal 20 in the log 10 so they cannot be easily removed without again compressing of squeezing the connector 40. To compress or squeeze the connector 40, there may be elongate pads 52 at the ends of a center rib 54 operable to be pressed together between fingertips. Center rib 54 extends transversely to the broad surfaces of the side walls of the body that extend between the arrowhead tips 42, and has two separated parts, one projecting outward from each side wall. The pads 52 are outside of the logs and thus easily accessible when it is desired to separate the logs from one another.

Figure 6:
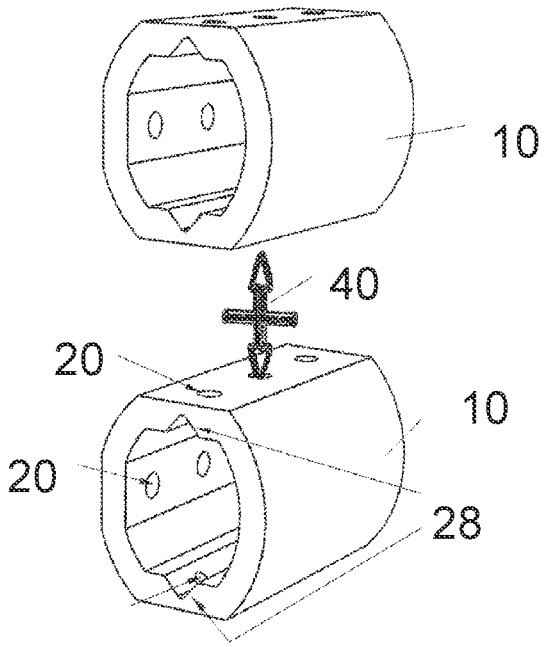
FIG. 6 illustrates a perspective view of logs and a squeeze connector in accordance with the invention.

FIG. 6 illustrates a pair of logs 10 vertically connected to each other with a double ended connector 40. Since the connectors 40 have tips 42 with voids 46 operable to compress between fingertips reducing their width (this compression being illustrated by the arrows in FIG. 7), they can be brought to this reduced state before being pushed through portals 20 of the two vertically positioned logs 10 to hold the two logs 10 together, one above the other. FIG. 7 thus shows the uncompressed state of the connector 40 to the left and the compressed state of the connector to the right. Once in place, connectors 40 are released so the tips 42 expand back to their original width, creating a significant interference with the portals 20 in each log wall so the logs 10 stay together in a vertical direction. These connectors 40 cannot be easily removed from the logs 10 until they are again squeezed and purposely removed.

The portals 20 which pass through the log wall's exterior sides allow fixed, pivoted, and/or removable connection between two logs 10. A "fixed" connection may be defined as one which is expected to or does cause damage or breakage to one of the parts of the log or connector when removed from engagement with one another. A "removable" connection may be defined as a connection that is able to connect and disconnect repeatedly (>about 6 times) without causing damage or breakage to a connector piece or parts being connected. A "pivoted" connection may be defined as a linkage that allows at least one degree of freedom of movement similar to a hinge between fastened logs or parts.

For safety reasons, the molded plastic connectors 40 are large enough to pass the toy industry's Small Part Gauge test to prevent swallowing of the connectors 40 by children. Toy industry studies have established that a diameter greater than 1.25 inches achieves a level of safety acceptable in toy design to pass this test. The connector 40 is also long enough to pass through the portals 20 in the walls 12, 14, 16, 18 of two stacked, adjacently positioned logs 10 so it can hold the logs 10 in place until the connector 40 is again compressed and removed from each log 10 (see FIG. 6).

Playsets including logs 10, panels 30 and connectors 40 in any number of each component, may allow for inside, outside and water-play, allowing children to build their own designs with a soft material that can be cut, bent and fastened together to create a wide range of entertaining playsets. These playsets or toys provide children not only excitement during the construction phase, but also a durable, imaginative educational toy that withstands rain, wind and intense sunlight just like existing rotomolded playhouses because the foam logs are also made of polyethylene exactly like the rotomolded products. This toy construction playset allows children to develop by thinking three-dimensional thoughts creating and building playsets with soft, large diameter foam extrusions.

Referring now to FIGS. 8-13, another embodiment of a squeeze connector 60 in accordance with the invention is used to connect for example, two logs together end to end, and parts of it have similar squeezable properties like squeeze connector 40 described above. Specifically, in a preferred use, squeeze connector 60 locks two pieces of extruded foam together in a horizontal direction, e.g., two logs 10 positioned end to end, by exerting a force pressing the logs against one another (see FIG. 13). Two short logs can thus be connected using squeeze connector 60 to form one long log.

Figure 8:
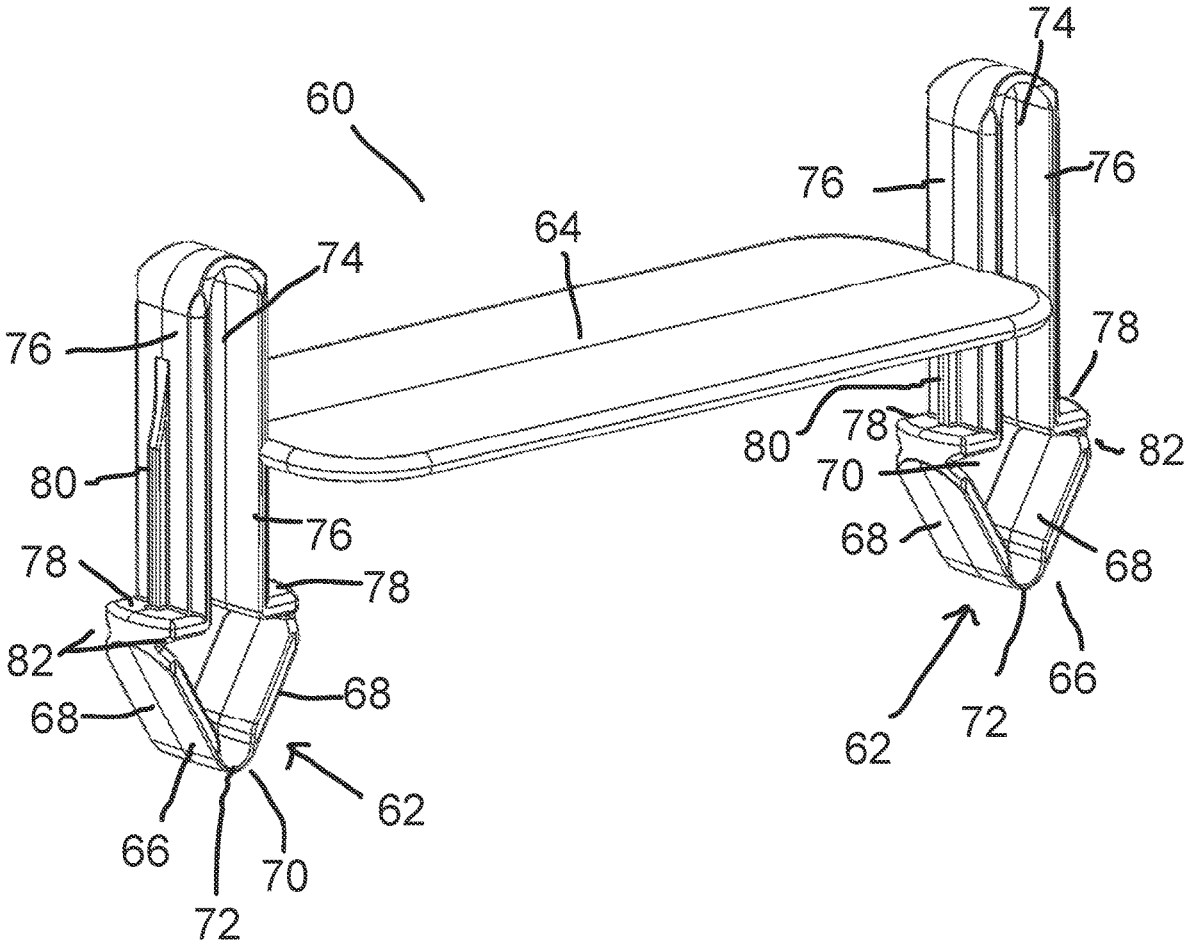
FIG. 8 is a perspective view of another embodiment of a squeeze connector in accordance with the invention.
Figure 9:
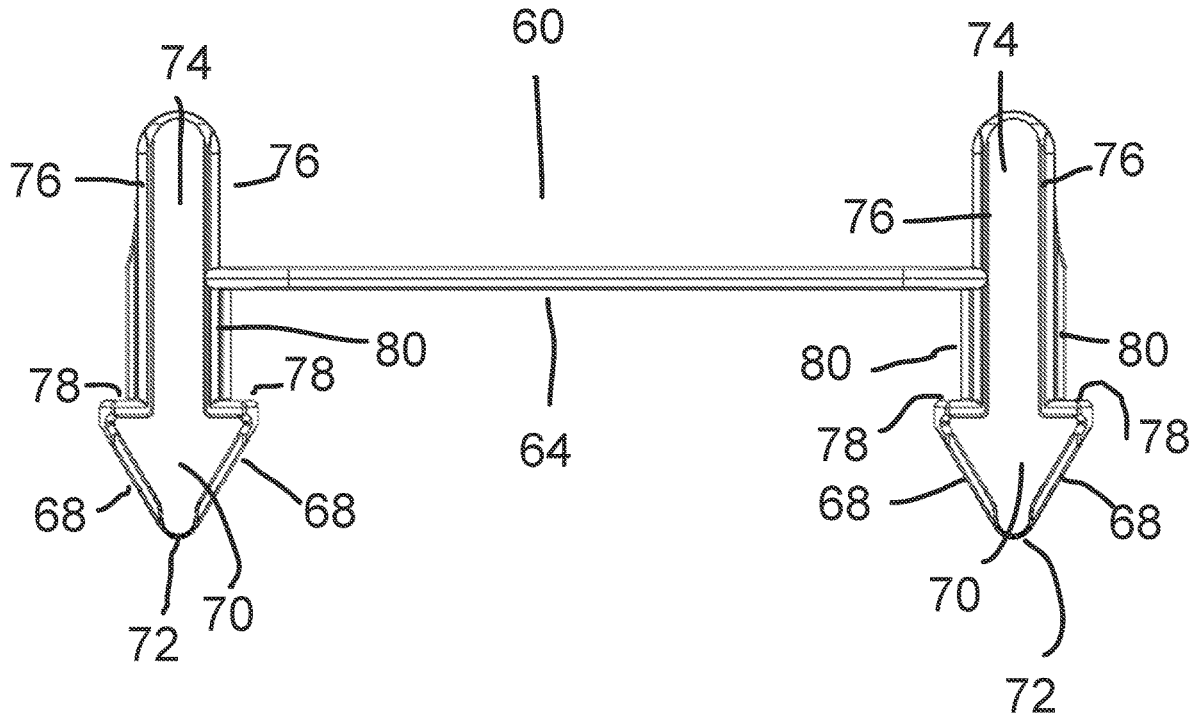
FIG. 9 is a front view of the squeeze connector of FIG. 8.
Figure 10:
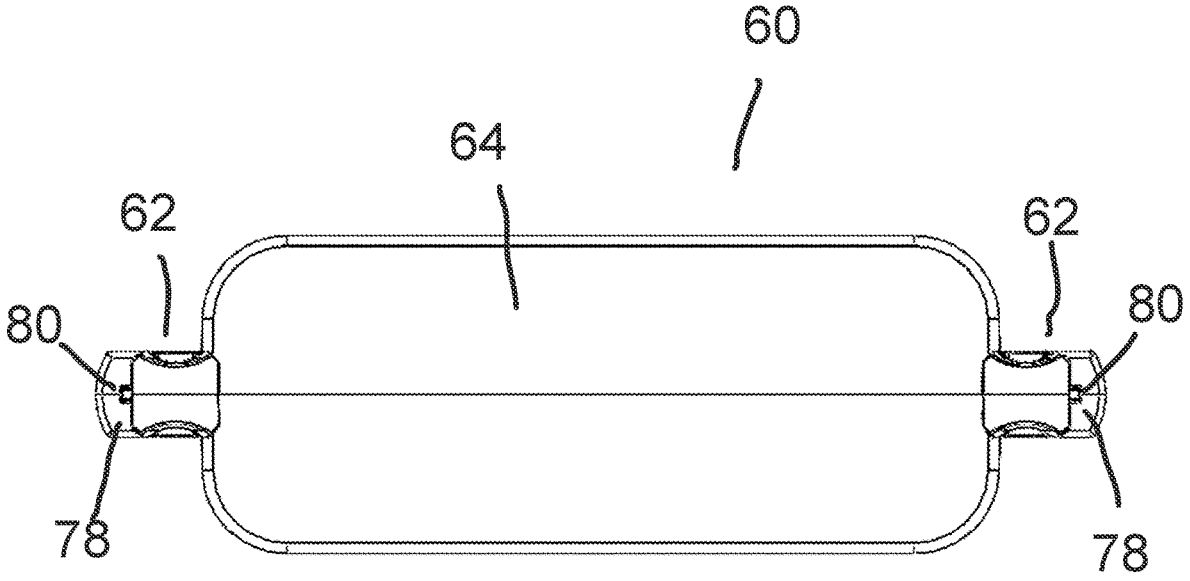
FIG. 10 is a top view of the squeeze connector of FIG. 8.
Figure 11:
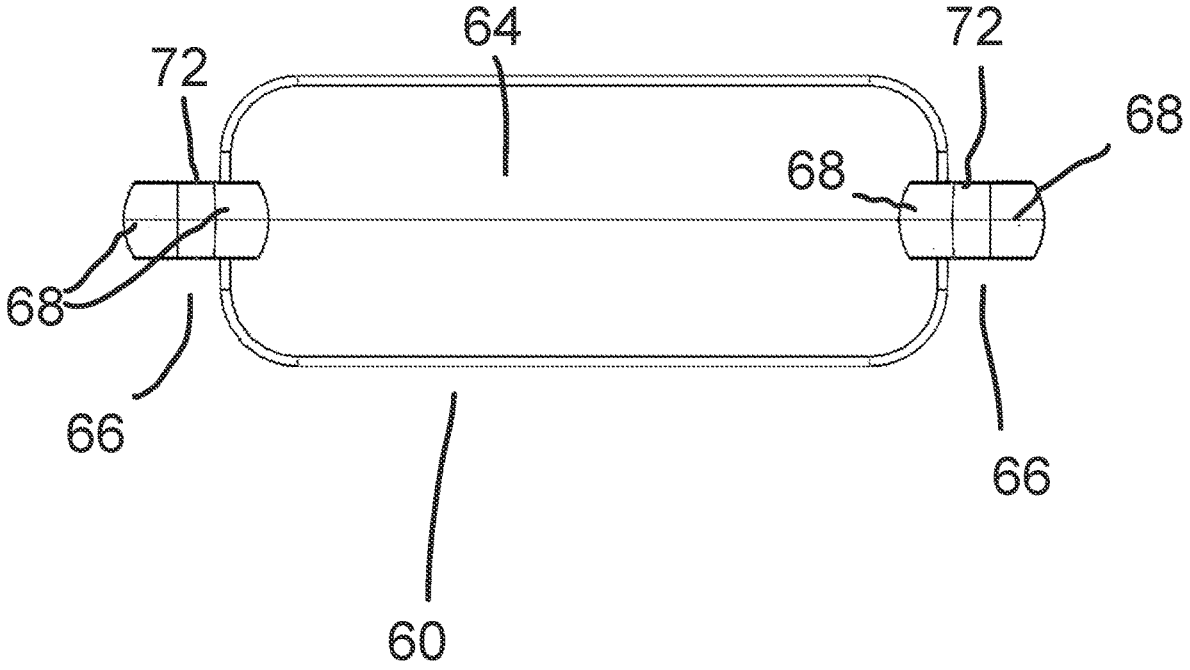
FIG. 11 is a bottom view of the squeeze connector of FIG. 8.

Squeeze connector 60 preferably has a unitary construction, i.e., is made of a single piece of plastic, or integral construction. The selection of the type of plastic and its manufacture would be readily ascertainable by those skilled in the art to which this invention pertains in view of the disclosure herein, Connector 60 includes two squeezable arrowhead tips 62 on opposite edges of a flat intermediate body portion 64, and which arrowhead tips 62 are oriented in the same direction (downward in the orientation of the connector 60 shown in FIGS. 8-12). Each arrowhead tip 62 includes a tip portion 66 defined by a pair of angled parts 68 at a lower end and which has a void 70 between the angled parts 68 (FIGS. 8 and 9). The angled parts 68 extend in opposite, upward directions from the tip edge 72, and toward the other end of the arrowhead tip 62. An angle of anywhere from about 30 degrees to about 60 degrees to the horizontal axis passing through the tip edge 72 is suitable but can vary as desired.

The void 70 of each tip portion 66 is continuous with the space 74 between opposed, elongate side walls 76 of the arrowhead tip 62 which extend from undercut surfaces 78 to the upper end of the arrowhead tip 62. The intermediate body portion 64 connects to the innermost of the two elongate side walls 76 of each arrowhead tip 62 at a location between the upper and lower edges thereof to provide the body of the connector 60 with an H-shape. The elongate side walls 76 are each recessed by a step on the side from the upward edge of the respective angled part 66 to form the undercut surface 78. There are preferably reinforcement ribs 80 extending axially along the outer surfaces of each of the elongate side walls 76 (vertically in the orientation shown), on the innermost elongate side wall 76 only until the body portion 64 (see FIGS. 8 and 9) and on the outermost elongate side wall 76 beyond the body portion 64 with a tapered transition to the elongate side wall 76 (see FIG. 12). Ribs 80 are positioned in an approximate center portion of the elongate side walls 76.

Figure 12:
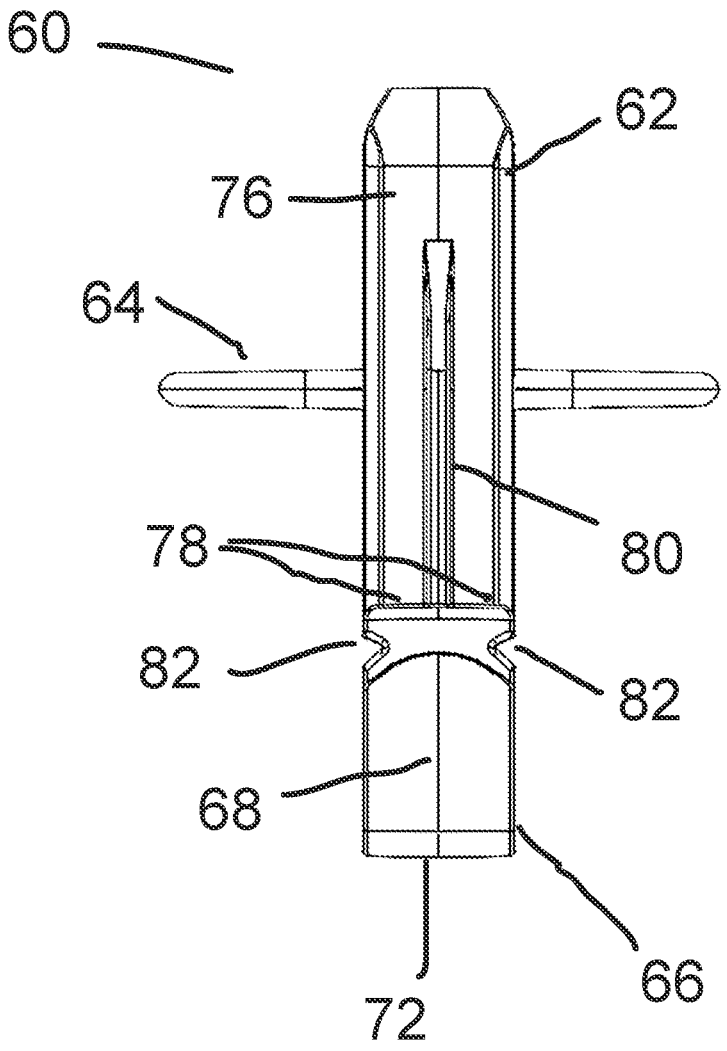
FIG. 12 is a side view of the squeeze connector of FIG. 8, the right and left side views being the same.

Notches 82 may be provided to form living hinges between the angled parts 68 and the undercut surfaces 78, and thereby aid in the squeezability of the tip portions 66 (see FIGS. 8 and 12).

Void 70 enables the angled parts 66 to be brought closer to one another to compress or squeeze the tip portion 66, narrowing its cross-sectional area, and enable its insertion in the narrowed form into a portal in the log. The space 74 between the side walls 76 allows for such compression. Hence, the arrowhead tips 62 are provided with their squeezable nature.

Intermediate body portion 64 may be flat and rigid. Its length, i.e., the distance between the edges at which the arrowhead tips 62 are positioned, is selected relative to the dimensions of the portals in the logs or panels with which the connector 60 will be used. A substantially rectangular body portion 64 may be provided, with the corners preferably rounded. The body portion 64 is spaced apart from the innermost undercut surfaces 78 to enable the tip portions 66 to be squeezable without interference from the body portion 64 (see FIGS. 8 and 9).

Figure 13:
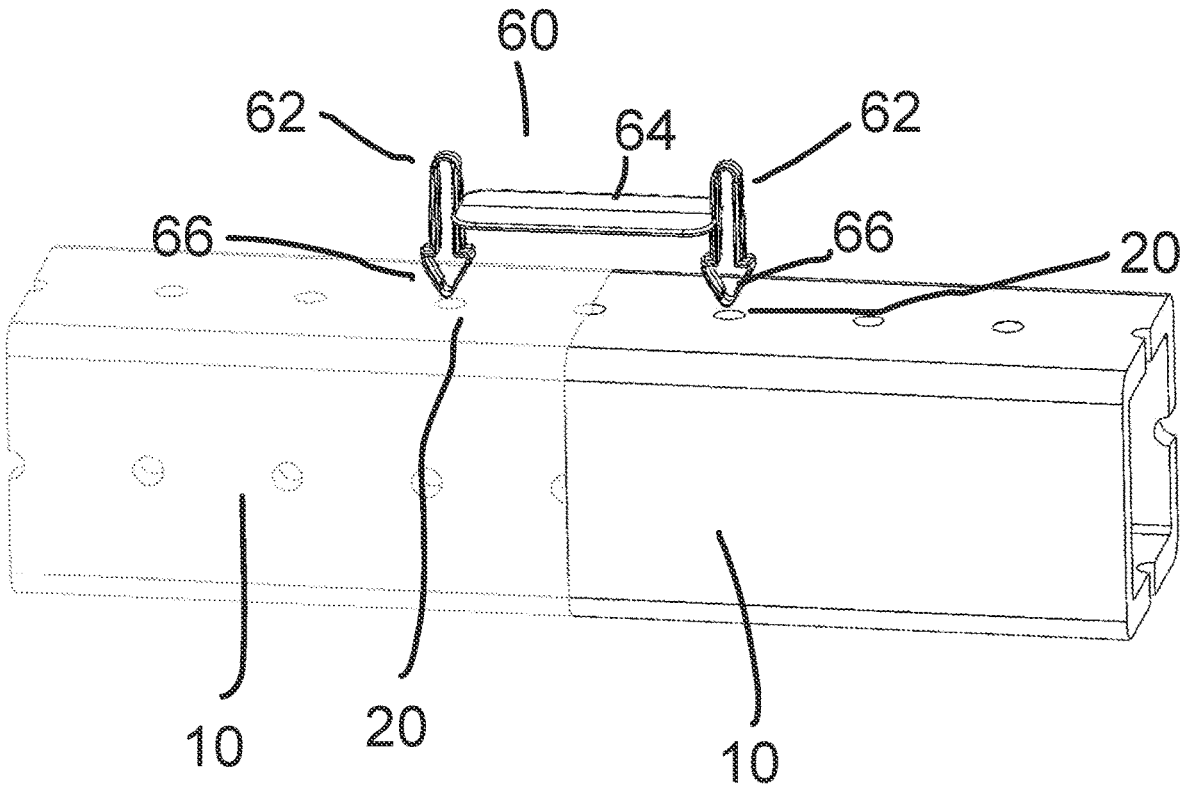
FIG. 13 is a view showing connection of two logs using the squeeze connector of FIG. 8.

Preferably, there should be a portal at a distance of about ½ the length of the intermediate body portion 64 from the edge of the log or panel to enable two logs or panels to be joined end to end (see FIG. 13).

The features of the connector 60 may be incorporated into the connector 40 to the extent not shown or described with reference thereto and vice versa.

The logs 10, panels 30, connectors 40, and arrowhead tips 62 of connectors 60 are designed relative to one another such that the tips 42 and tip portions 66 are larger than the portals in the logs 10 and panels 30. Once the compressive force on the tips 42 and tip portions 66 is removed, i.e., after the tips 42 and tip portions 66 have been inserted into and are present in spaces in the logs, the tips 42 and tip portions 66 expand to their original width, geometry and shape. This expansion is a property of the material from which the connectors 40 and arrowhead tips 62 of connectors 60 are formed, e.g., memory plastic. Since the undercut surfaces 48, 78 of the tips 42 and tip portions 66 press against the inner surface of the logs, the logs are held together. Connectors 40 and arrowhead tips 62 cannot be easily removed from the logs until they are again squeezed, and purposely removed.

Another way to view the connectors 40, 60 is as a single unitary body with two arrowhead tips (although more than two arrowhead tips are possible as well). The arrowhead tips each include a triangular region that is compressible and a rectangular region behind the triangular region. The triangular region is compressed or squeezed to reduce the size of the triangular region to enable it to pass through a portal in a log 10 or panel 30, and then when the squeezing force is removed, the triangular region expands to its triangular shape and the undercut surfaces between the triangular region and the rectangular region abut against the underside of the log 10 or panel 30 around the portal and prevent removal of the triangular region of the tip from engagement with the log 10 or panel 30.

In the embodiment of FIGS. 3-5, the arrowhead tips are connected together on opposite sides of the body to enable adjacent logs 10 or panels 30 to be connected together alongside one another, whereas in the embodiment of FIGS. 8-13, the arrowhead tips are separated laterally from one another by the intermediate body portion 64 so as to connect components end to end. Other relative positionings of the two arrowhead tips are also possible in the invention.

The toy construction playset in accordance with the invention dramatically reduces the amount of plastic needed to build to a playhouse by roughly 85% so the resulting playhouses are much more environmentally friendly and all of the logs are 100% recyclable.

Building playsets in the real world may be assisted by augmented reality software on a computer platform such as an iPad, so children can build and play with their playsets online, on their own computer, as well as in the real world. The software will allow children to see and walk around their designs viewing their playsets on their computer or phone screens full size as if they already existed in the real world and may include augmented reality software. The program will also provide step by step instructions for constructing the playsets in the real world based on how the children constructed them in the virtual world. The program will provide the optimal list of log cuts so children can make their designs using a minimum number of logs 10, panels 30 and connectors 40.

Figure 14:
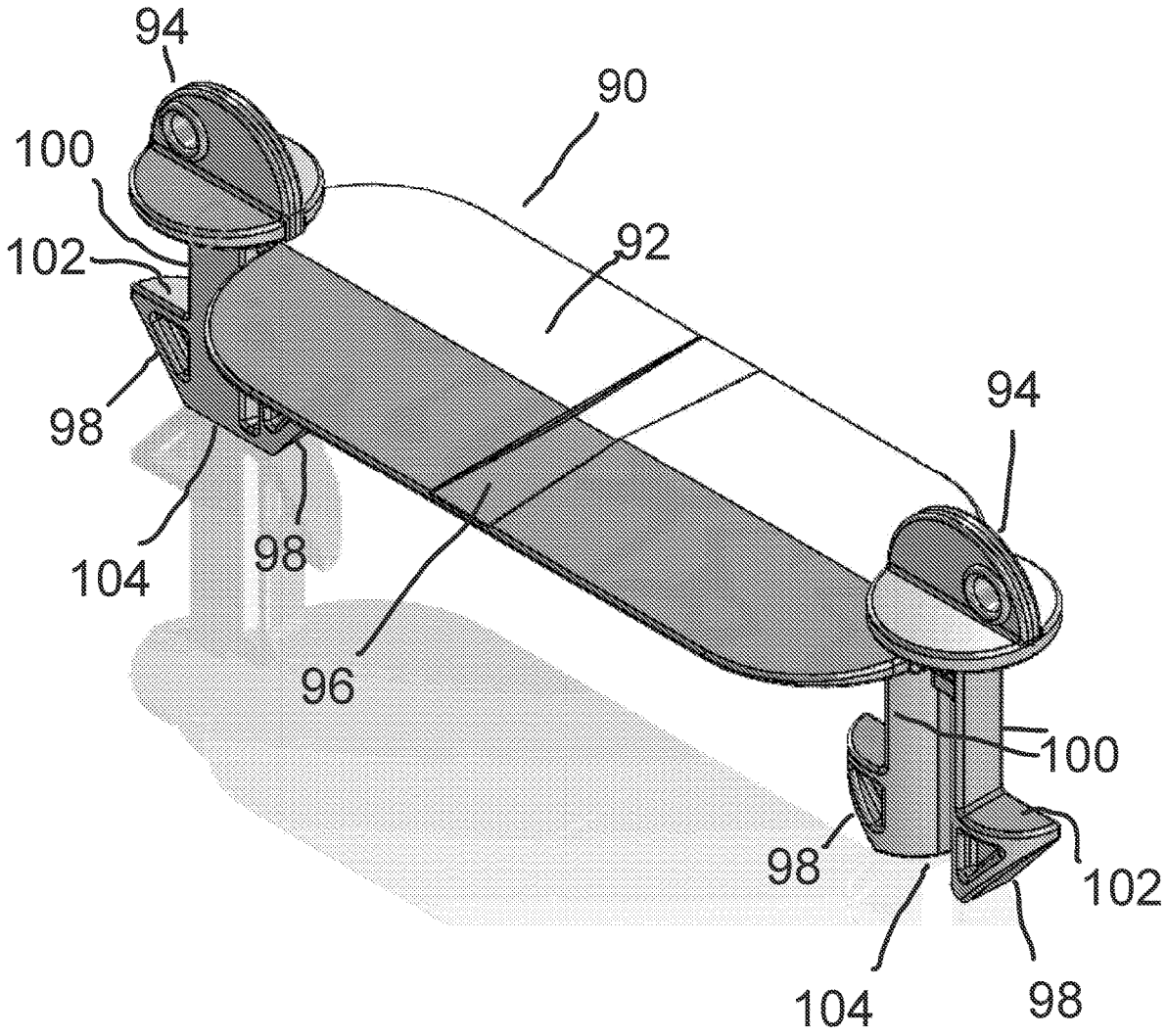
FIG. 14 is a perspective view of a squeeze connector similar to that shown in FIGS. 8-13

FIG. 14 shows a different squeeze connector 90 in accordance with the invention wherein the intermediate body portion 92 that extends between two laterally spaced apart arrowhead tips 94 on opposite lateral sides of the intermediate body portion 92 is hinged. An elongate living hinge 96 is formed in an approximate middle or central region of the intermediate body portion 92, and it functions very similar to a door hinge in an assembly. In one embodiment, the hinge 96 is formed by a thinner or thinned region of the material of the intermediate body portion 92, whether during formation or afterwards. This hinge 96 can be incorporated into the intermediate body portion 64 of connector 60 described above. Generally, the hinge 96 is elongate extending between opposite lateral edges of the intermediate body portion 64, and extends in a direction transverse to a line between the arrowhead tips 94 to enable the arrowhead tips 94 to pivot relative to one another.

FIG. 14 also shows a different structure for the arrowhead tips 94. The arrowhead tips 94 still include angled parts 98 and side walls 100 forming undercut surfaces 102 therebetween, but a tip portion 104 does not include a tip edge. Thus, the tip portion 104 has a truncated triangular shape. The compressibility of the tip portion 104 allows for entry of the tip portion 104 into a portal of a playset component, and its forced, but not inadvertent, removal therefrom.

The Features of the Connector 90 May be Incorporated into the Connector 60 to the Extent not Shown or Described with Reference Thereto and Vice Versa.

FIGS. 15-18 show another embodiment of a squeeze connector 40A in accordance with the invention which is very similar to squeeze connector 40 and therefore the same reference numbers refer to the same elements. Connector 40A differs from connector 40 in that it does not include the pads 52 at the ends of the center rib 54 that extend away from broad surfaces of the side walls in a transverse direction (see FIGS. 3 and 5) and that have the same width as the width of the bulk of the connector 40 (see FIG. 4).

Figure 16:
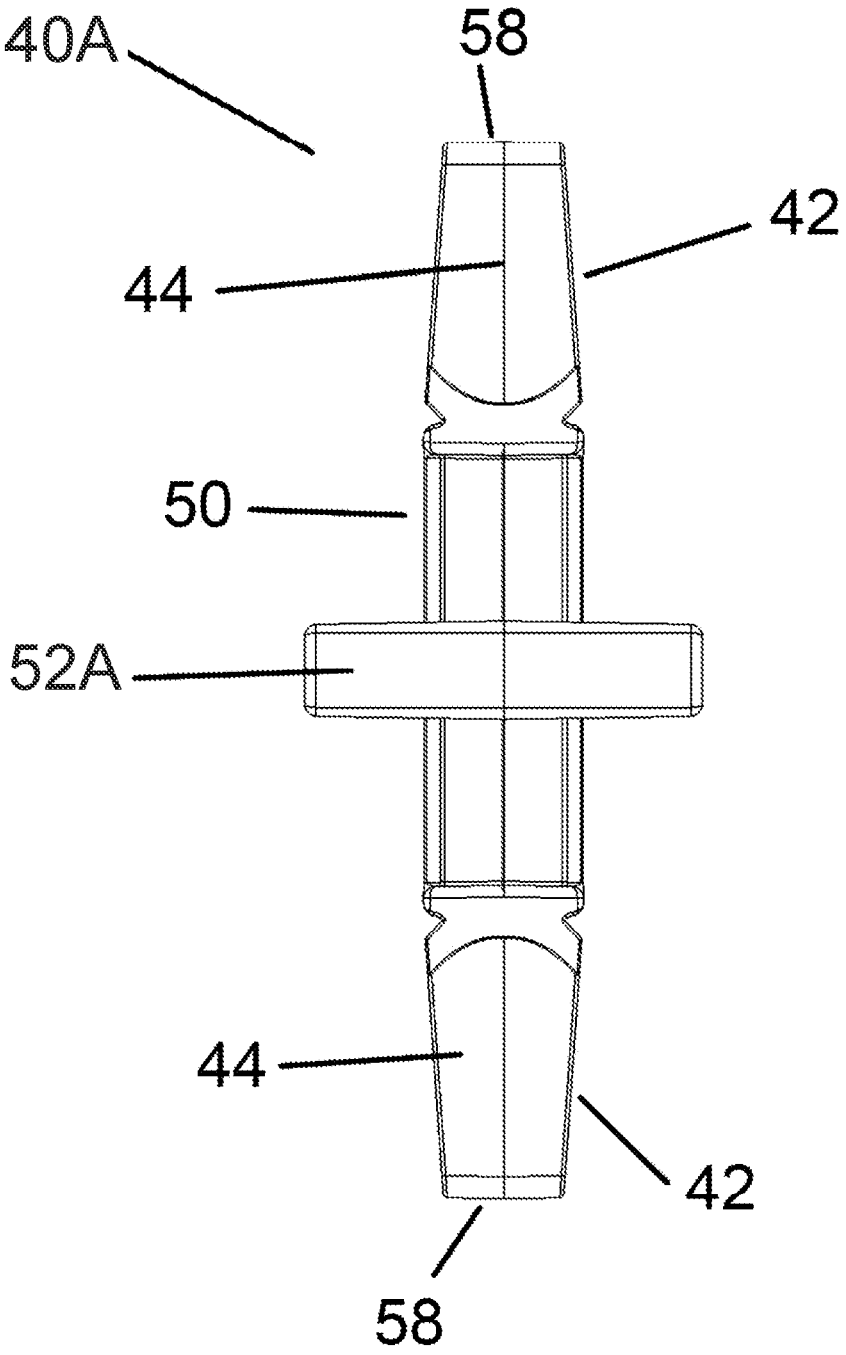
FIG. 16 is a side view of the connector shown in FIG. 15.
Figure 18:
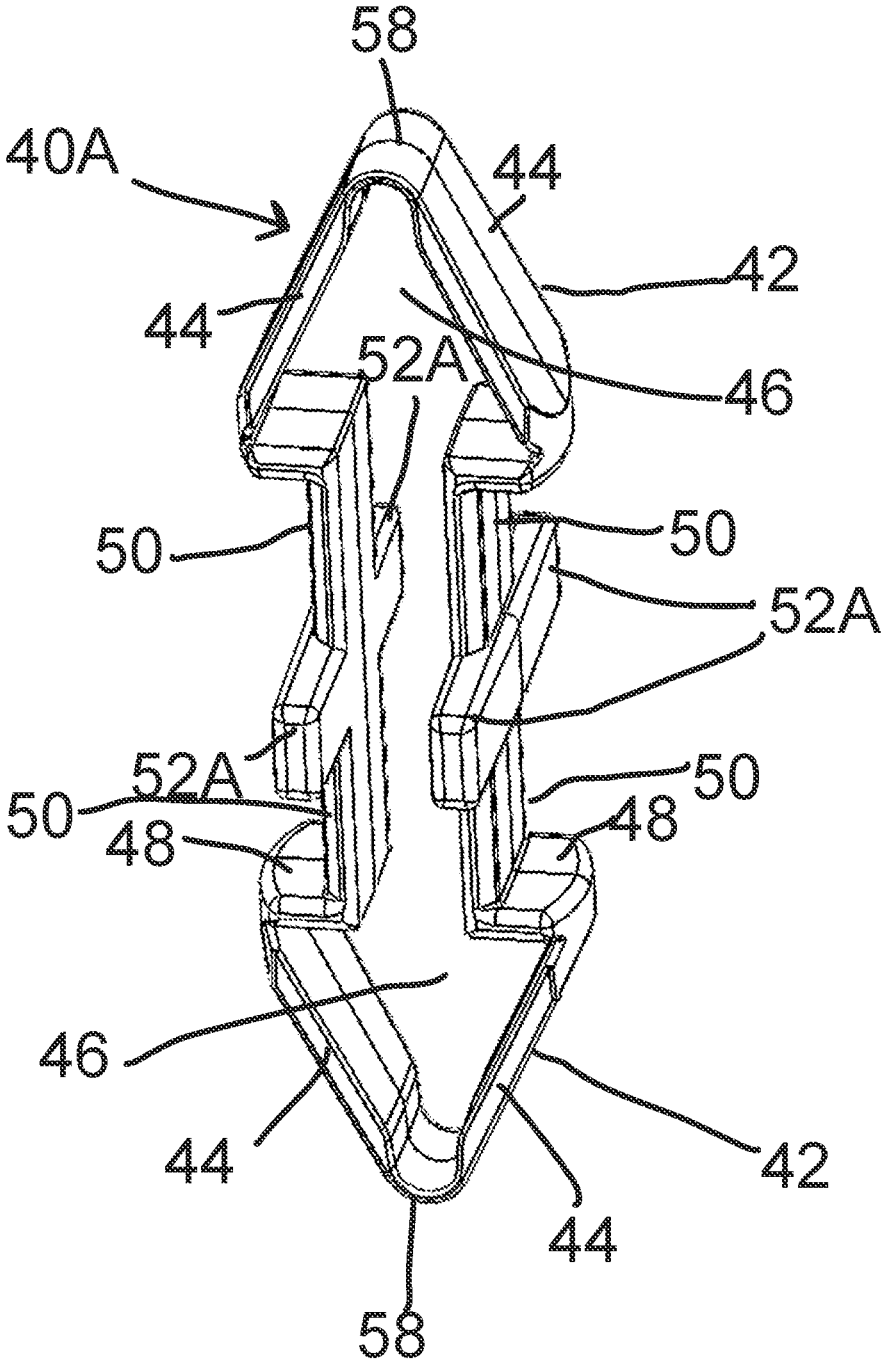
FIG. 18 is a top, perspective view of the connector shown in FIG. 15.

Rather connector 40A includes elongate pads 52A that extend in directions away from the narrow surfaces of the side walls and are alongside the broad surface of each side wall (best seen in FIGS. 16 and 18). Each pad 52A extends substantially perpendicular to the respective side wall in a direction outward from a narrow surface of the side wall (see FIG. 16). There is a single pad 52A alongside each side wall and it extends in both directions to a point beyond the width of the connector 40A. A larger surface area is provided by the broad surfaces of the pads 52A to the user to enable the user to push the side walls together in order to compress the arrowhead tips 42 (see FIG. 16). The length of the pads 52A, i.e., the extent to which they extend beyond the width of the connector 40A, is variable depending on optimization of the surface area to be accessible to the user and the separation between the logs or other playset components being connected together.

Figure 15:
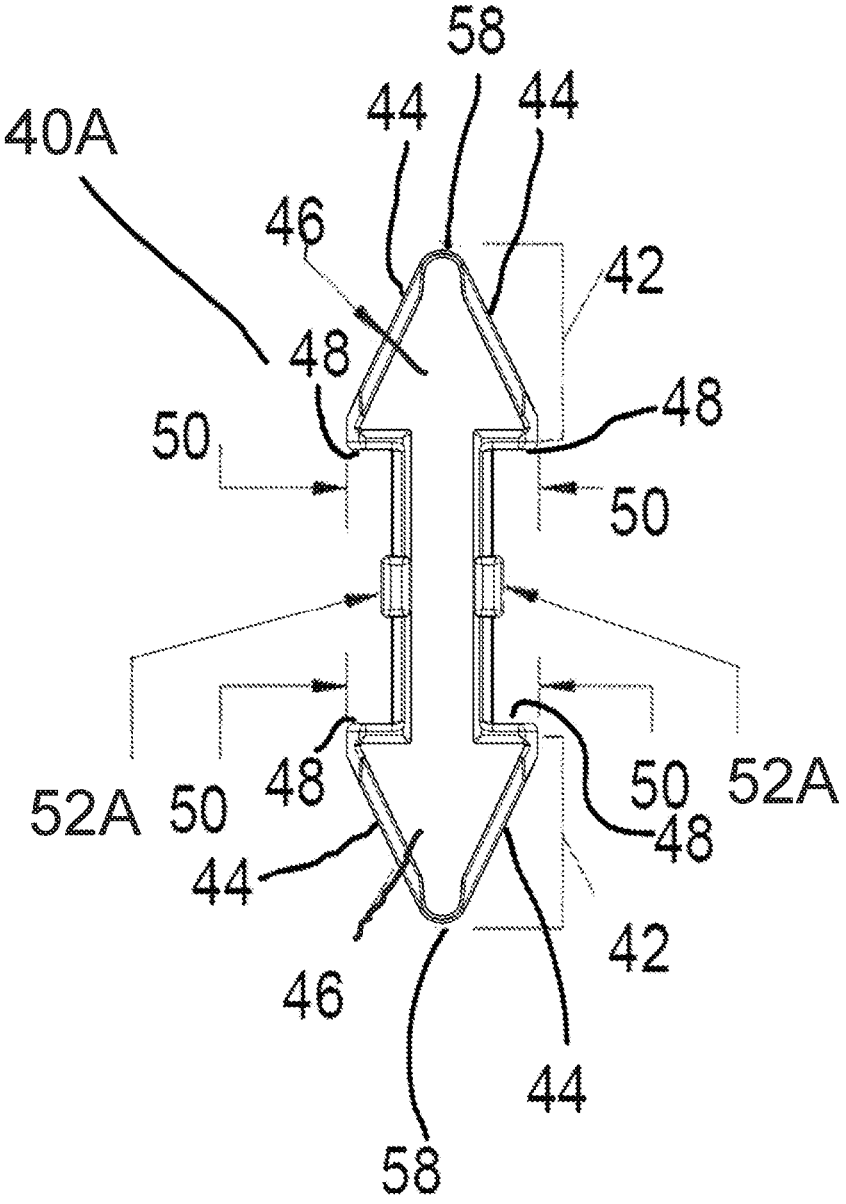
FIG. 15 is a front view of another embodiment of a squeeze connector in accordance with the invention similar to the connector shown in FIGS. 3-5.
Figure 17:
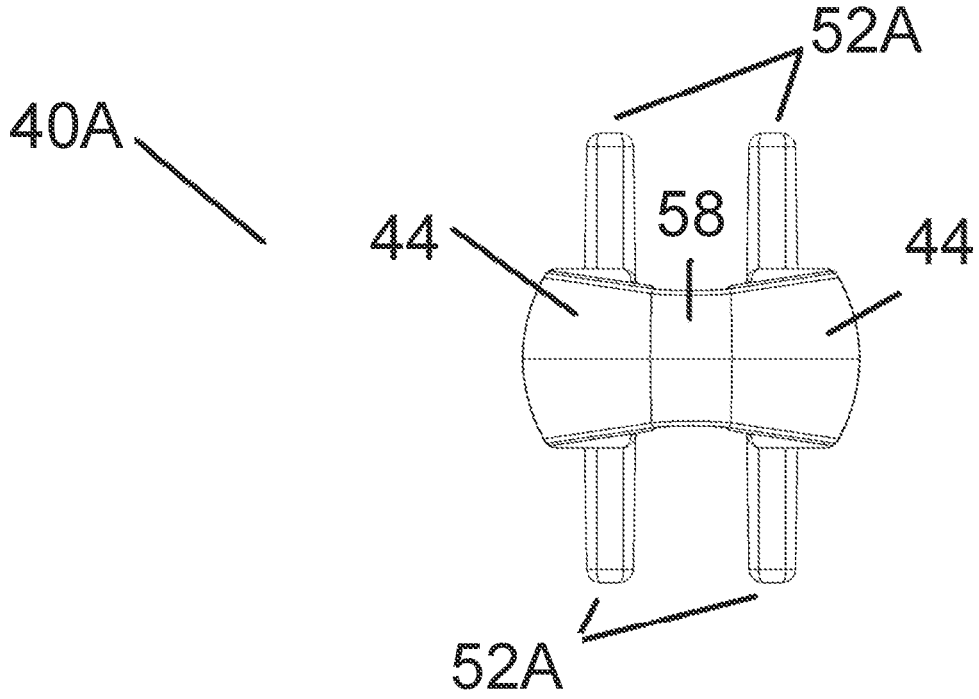
FIG. 17 is a top view of the connector shown in FIG. 15.

Pads 52A on each of the side walls may be the same length and be positioned opposite one another (see FIG. 17). As shown in FIG. 15, the width of the pads 52A is small so that they do not extend beyond the outermost edges of the angled parts 44 (compare to FIG. 3 for connector 40). FIG. 16 shows that the angled parts 44 of the tip portion 42 may taper inward to thereby have a reduced width at the tip edge 58.

This embodiment addresses the likelihood that the users, often children, squeeze the connector anywhere between the arrowhead tips 42 so the usefulness of the extension arms for squeezing together (pads 52 and ribs 54 in the embodiment of FIGS. 3-5 with the pads 52 spaced apart from the side walls) is reduced since the pads 52A are directly on the side walls, and a more user-friendly embodiment providing greater surface area for compression is desirable. However, it should be understood by those skilled in the art to which this invention pertains that the center ribs 54 and pads 52 thereon in connector 40 or alternatively the pads 52A on the side walls in connector 40A are optional features, although preferred. Moreover, other structure that improves the ability or ease of a user squeezing from the sides of the connector to cause the tip portions of the arrowhead tips to compress may be used in the invention, however connected to the side walls or structured. All such alternative or additional constructions that function in the same way as the ribs 54 and pads 52 or pads 52A are considered to be encompassed by the term squeeze assistance means as used herein.

The features of the connector 40A may be incorporated into the connector 40 to the extent not shown or described with reference thereto and vice versa.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the following claims. Among other modifications, features of the U.S. patent documents mentioned above, all of which are incorporated by reference herein, can be used in the fasteners or connectors in accordance with the invention to the extent possible, and all such modifications are considered by the inventor to be part of the invention.

The invention claimed is:

1. A connector that enables two playset components to be connected together, comprising:

a body having first and second arrowhead tips and first and second elongate, opposed side walls, said first and second elongate side walls being spaced apart from one another, said first elongate side wall having a first end connected to said first arrowhead tip and a second end opposite the first end connected to said second arrowhead tip, said second elongate side wall having a first end connected to said first arrowhead tip and a second end opposite the first end of said second elongate side wall connected to said second arrowhead tip, each of said first and second arrowhead tips having an expanded form in which each of said first and second arrowhead tips is retainable in connection with a respective one of the playset components and a narrowed form in which each of said first and second arrowhead tips is insertable into and removable from the respective one of the playset components through a portal therein, each of said first and second arrowhead tips being squeezable from the expanded form to the narrowed form by pressing said first and second elongate side walls toward one another, whereby each of said first and second arrowhead tips returns to the expanded form from the narrowed form upon release on the pressing of said first and second elongate side walls toward one another, and wherein said body has only said first and second arrowhead tips, one at each of two opposite ends of said body and said first and second arrowhead tips are oriented in opposite directions, and wherein said body further comprises a first rib extending outward from said first elongate side wall in a direction perpendicular to said first elongate side wall, a second rib extending outward from said second elongate side wall in a direction perpendicular to said second elongate side wall, and a respective pad at an outward end of each of said first and second ribs, whereby pressing said respective pads inward causes said first and second elongate side walls to be pressed toward one another and said first and second arrowhead tips to be squeezed from the expanded form to the narrowed form.

2. The connector of claim 1, wherein said body has a unitary construction in that it is made of one piece of material.

3. The connector of claim 1, wherein said first arrowhead tip comprises a tip edge and a pair of angled parts separated from one another to define a void therebetween, said angled parts extending in opposite directions from said tip edge, and said second arrowhead tip comprises a tip edge and a pair of angled parts separated from one another to define a void therebetween, said angled parts of said second arrowhead tip extending in opposite directions from said tip edge of said second arrowhead tip.

4. The connector of claim 3, wherein said first arrowhead tip has undercut surfaces on an opposite side of said angled parts of said first arrowhead tip from said tip edge of said first arrowhead tip, said second arrowhead tip has undercut surfaces on an opposite side of said angled parts of said second arrowhead tip from said tip edge of said second arrowhead tip, and said first and second elongate side walls providing said body with a portion having a reduced dimension relative to a side of said first and second arrowhead tips opposite said tip edge of said first and second arrowhead tips respectively to thereby define the undercut surfaces, said portion being compressible to thereby cause movement of said first and second arrowhead tips into their narrowed form.

5. The connector of claim 1, wherein said first rib is centrally located, and said second rib is centrally located.

6. The connector of claim 1, wherein said first arrowhead tip includes a first compressible triangular region, said second arrowhead tip includes a second compressible triangular region, and said body defines a rectangular region between said first and second elongate side walls that connects said first and second triangular regions, said body further including undercut surfaces between said first triangular region and said rectangular region and between said second triangular region and said rectangular region, said first and second triangular regions being compressed or squeezed to reduce their size.

7. The connector of claim 1, wherein said body has a uniform thickness.

8. The connector of claim 1, wherein said body further comprises at least one reinforcement rib extending axially along an outer surface of each of said first and second elongate side walls, an axial direction being a direction between said first and second arrowhead tips.

9. The connector of claim 5, wherein said first centrally located rib extends outward from a broad surface of said first elongate side wall and said second centrally located rib extends outward from a broad surface of said second elongate side wall in a direction.

10. A connector that enables two playset components to be connected together, comprising:

a body having first and second arrowhead tips and first and second elongate, opposed side walls, said first and second elongate side walls being spaced apart from one another, said first elongate side wall having a first end connected to said first arrowhead tip and a second end opposite the first end connected to said second arrowhead tip, said second elongate side wall having a first end connected to said first arrowhead tip and a second end opposite the first end of said second elongate side wall connected to said second arrowhead tip, each of said first and second arrowhead tips having an expanded form in which each of said first and second arrowhead tips is retainable in connection with a respective one of the playset components and a narrowed form in which each of said first and second arrowhead tips is insertable into and removable from the respective one of the playset components through a portal therein, each of said first and second arrowhead tips being squeezable from the expanded form to the narrowed form by pressing said first and second elongate side walls toward one another, whereby each of said first and second arrowhead tips returns to the expanded form from the narrowed form upon release on the pressing of said first and second elongate side walls toward one another, and wherein said body further comprises a first elongate pad extending alongside said first elongate side wall and a second elongate pad extending alongside said second elongate side wall, said first and second elongate pads being opposite one another, whereby pressing said first and second elongate pads inward causes said first and second elongate side walls to be pressed toward one another and said first and second arrowhead tips to be squeezed from the expanded form to the narrowed form.

11. The connector of claim 10, wherein said first arrowhead tip comprises a tip edge and a pair of angled parts separated from one another to define a void therebetween, said angled parts extending in opposite directions from said tip edge, and said second arrowhead tip comprises a tip edge and a pair of angled parts separated from one another to define a void therebetween, said angled parts of said second arrowhead tip extending in opposite directions from said tip edge of said second arrowhead tip.

12. The connector of claim 10, wherein said first arrowhead tip includes a first compressible triangular region, said second arrowhead tip includes a second compressible triangular region, and said body defines a rectangular region between said first and second elongate side walls that connects said first and second triangular regions, said body further including undercut surfaces between said first triangular region and said rectangular region and between said second triangular region and said rectangular region, said first and second triangular regions being compressed or squeezed to reduce their size.

13. A connector that enables two playset components to be connected together, comprising:

a body having a first arrowhead tip and a pair of opposed first and second elongate side walls each connected at one end to said first arrowhead tip, said body having a second arrowhead tip and a pair of opposed third and fourth elongate side walls each connected at one end to said second arrowhead tip, each of said first and second arrowhead tips having an expanded form in which each of said first and second arrowhead tips is retainable in connection with a respective one of the playset components and a narrowed form in which each of said first and second arrowhead tips is insertable into and removable from the respective one of the playset components through a portal therein, wherein said first and second arrowhead tips are laterally spaced apart from one another and oriented in a common direction, and wherein said body further comprises a flat intermediate body portion connected at one edge to said first elongate side wall and at an opposite edge to said third elongate side wall to laterally space said first and second arrowhead tips apart from one another.

14. The connector of claim 13, wherein said first arrowhead tip comprises a tip portion including a tip edge and a pair of angled parts separated from one another to define a void therebetween, said angled parts extending in opposite directions from said tip edge, and said second arrowhead tip comprises a tip portion including a tip edge and a pair of angled parts separated from one another to define a void therebetween, said angled parts of said second arrowhead tip extending in opposite directions from said tip edge of said second arrowhead tip.

15. The connector of claim 14, wherein said first and second elongate side walls are connected to said tip portion of said first arrowhead tip and define a space continuous with said void of said tip portion of said first arrowhead tip and said third and fourth elongate side walls are connected to said tip portion of said second arrowhead tip and define a space continuous with said void of said tip portion of said second arrowhead.

16. The connector of claim 15, wherein said first and second elongate side walls extend from undercut surfaces defined between said tip portion of said first arrowhead tip and said first and second elongate side walls, and said third and fourth elongate side walls extend from undercut surfaces defined between said tip portion of said second arrowhead tip and said third and fourth elongate side walls.

17. The connector of claim 15, wherein said body further comprises reinforcement ribs on outer surfaces of said first, second, third and fourth elongate side walls and extending in a direction alongside said first, second, third and fourth elongate side walls and between edges of said first, second, third and fourth side walls.

18. The connector of claim 13, wherein said intermediate body portion includes a hinge extending in a direction transverse to a line between said first and second arrowhead tips to enable said first and second arrowhead tips to pivot relative to one another.

19. The connector of claim 13, wherein said intermediate body portion is rigid.

20. The connector of claim 13, wherein said intermediate body portion and said first and third elongate side walls form an H-shape.

* * * * *